US005163760A

United States Patent [19]

Nardozzi

[11] Patent Number: 5,163,760

[45] Date of Patent: Nov. 17, 1992

[54] METHOD AND APPARATUS FOR DRIVING A THERMAL HEAD TO REDUCE PARASITIC RESISTANCE EFFECTS

[75] Inventor: Frank M. Nardozzi, Webster, N.Y.

[73] Assignee: Eastman Kodak Company, Rochester, N.Y.

[21] Appl. No.: 800,302

[22] Filed: Nov. 29, 1991

[51] Int. Cl.[5] ..... B41J 2/37

[52] U.S. Cl. ..... 400/120; 346/76 PH; 358/298

[58] Field of Search ..... 400/120; 346/76 PH, 346/107 R; 358/296, 298

[56] References Cited

U.S. PATENT DOCUMENTS

| | | | |
|---|---|---|---|
| 4,205,387 | 5/1980 | Ovshinsky et al. | 364/900 |
| 4,346,449 | 8/1982 | Ovshinsky et al. | 364/900 |
| 4,464,669 | 8/1984 | Sekiya et al. | 346/76 |
| 4,494,126 | 1/1985 | Todoh | 346/76 |
| 4,514,738 | 4/1985 | Nagato et al. | 346/76 |
| 4,516,135 | 5/1985 | Todoh | 346/76 |
| 4,535,340 | 8/1985 | Moriguchi et al. | 346/76 |
| 4,536,774 | 8/1985 | Inui et al. | 346/76 |
| 4,540,991 | 9/1985 | Kariya et al. | 346/76 |
| 4,540,999 | 9/1985 | Arai | 346/216 |
| 4,563,691 | 1/1986 | Noguchi et al. | 346/76 |
| 4,573,058 | 2/1986 | Brooks | 346/76 |
| 4,574,293 | 3/1986 | Inui et al. | 364/76 |
| 4,633,269 | 12/1986 | Mikami et al. | 346/76 |
| 4,679,055 | 7/1987 | Inui et al. | 46/76 |
| 4,699,531 | 10/1987 | Ulinski, Sr. et al. | 400/74 |
| 4,701,836 | 10/1987 | Horlander | 346/76 |
| 4,710,783 | 12/1987 | Caine et al. | 346/76 PH |
| 4,724,336 | 2/1988 | Ichikawa et al. | 307/150 |
| 4,724,446 | 2/1988 | Hirahara et al. | 346/76 |
| 4,758,966 | 7/1988 | Brooks et al. | 364/519 |
| 4,795,281 | 1/1989 | Ulinski et al. | 400/74 |
| 4,814,787 | 3/1989 | Doi | 346/1.1 |
| 4,827,279 | 5/1989 | Lubinsky et al. | 346/1.1 |
| 4,835,549 | 5/1989 | Samejima | 346/107 R |
| 4,887,092 | 12/1989 | Pedruhn et al. | 346/1.1 |
| 4,967,192 | 10/1990 | Hirane | 346/107 R |
| 4,996,487 | 2/1991 | McSparran et al. | 324/549 |

*Primary Examiner*—David A. Wiecking
*Assistant Examiner*—Steven S. Kelley
*Attorney, Agent, or Firm*—Raymond L. Owens

[57] ABSTRACT

A thermal print head having a plurality of resistive heat elements and associated individual current sources which are enabled allowing selectable currents to pass through each of the selected thermal print elements. In a binary mode, the current sources can be operated to select a first or second current level, where the first current level is insufficient to form an optical density in the printed image and the second results in an optical density being formed. Alternatively, the current sources are coupled to binary word decoding networks and resistive ladders for decoding up to $2^n$ discrete density codes, where n corresponds to the number of bits in the word decoded at the current driver. The current source for each element is coupled to a voltage reference source through a pair of complementary load resistors and switching transistors such that regardless of the binary value applied, the reference voltage source is loaded by one or the other of the load resistors. In this fashion, the reference voltage is loaded by the same total load resistance regardless of the number of thermal print heat elements in the array that are energized for printing at any given time. In a binary, n-bit word decoding embodiment, the resistors of each resistance ladder for each current source and thermal print element effectively function as the total load presented to the reference voltage regardless of the n-bit data value decoded to provide the $2^n$ discrete print density levels.

3 Claims, 4 Drawing Sheets

METHOD AND APPARATUS FOR DRIVING A THERMAL HEAD TO REDUCE PARASITIC RESISTANCE EFFECTS

BACKGROUND OF THE INVENTION

1. Field of the Invention

The present invention relates to thermal printers and more particularly to circuitry for supplying energy to thermal print head heat elements.

2. Background of the Invention

As is well known in the art, a thermal print head utilizes a row of closely spaced resistive heat generating elements or thermal point elements which are selectively energized to record data in hard copy form. The data may comprise stored digital information relating to text, bar codes or graphic images. In operation, the thermal print elements receive energy from a power supply through driver circuits in response to the stored digital information. The heat from each energized element may be applied directly to thermal sensitive material or may be applied to a dye-coated web to cause transfer of the dye by diffusion to paper or other receiver material. The Kodak ® XL7700 digital continuous tone printer contains such thermal print elements and operates in this fashion.

The power delivered to the media to form an optical density at a pixel is a function of the power dissipated in the resistive heat generating element. The power dissipated in a thermal print element is equal to the square of the voltage drop across the thermal print element divided by the resistance of the element.

A typical single density image printer is shown functionally in FIG. 1. In the printing mode, an electrical voltage from the power supply, Vs, is applied across the thermal print elements, Re1–Ren. The electronic circuitry to permit current to pass through one or more of the elements exists in the printer and is necessary to perform the printing function. For the purpose of this description, the circuitry can be simplified to a shift register, SR1–SRn, an enable signal, E1, logical gates, AND1–ANDn, and transistor switches, T1–Tn. The complexity of these devices varies for different printers; however, this basic functionality exists in each of the different designs.

In the printing mode, the shift register, SR1–SRn, is loaded with a logical "1" at each location corresponding to a pixel where there is a desire to form an optical density. The outputs of the shift register, SR1–SRn, are logically anded with an enable pulse, E1, in the and gates AND1–ANDn. The enable pulse, E1, is formed to represent the duration that a current is desired to pass through the thermal print elements, Re1–Ren. The output of the gates, AND1–ANDn, biases transistor switches, T1–Tn, to allow current to pass through the corresponding thermal print elements, Re1–Ren, to ground. The energy transferred to the media to form an optical density is typically a function of the voltage drop across the thermal print element and the duration that the current is allowed to pass through the thermal print element.

The relationship of the optical density formed at a pixel to the energy dissipated in the associated thermal print element is calibrated and is expected to remain constant during the time interval between calibrations. If the voltage applied to the thermal print element is changed by some mechanism, the relationship between the optical density formed at a pixel to the power dissipated in the associated thermal print element is also modified. The result of this change is that the optical density formed at the pixel is not predictable or desired. This may be measured as either an increase or decrease in the optical density of the pixel. Thermal print element power dissipation equations that apply in this printer configuration are as follows:

$$Pret = \frac{(VRe)^2}{Ret} \qquad \text{Equation 1}$$

$$Vre = \frac{Vs*(Ret/n)}{Rh + (Ret/n)} \qquad \text{Equation 2}$$

$$Pret = \frac{(Vs^2)(Ret/n^2)}{(Ret)\,(Rh + (Ret/n))^2} \qquad \text{Equation 3}$$

As shown in Equation 1, the power dissipated in a thermal print element is equal to the square of the voltage drop across the thermal print element, VRe, divided by the resistance of the element, Ret. The voltage VRe is determined by the power supply voltage, Vs, and the voltage divider relationship of the harness resistance and the parallel resistance of the enabled thermal print elements as shown in Equation 2. The number of enabled thermal print elements is signified as n. The power dissipated in a thermal print element, PRet, is equal to the square of the voltage drop across the thermal print element divided by the resistance of the thermal print element, Ret, as shown in Equation 3.

A plot of the power dissipated in one thermal print element versus the number of energized thermal print elements for three possible values of harness resistance is provided in FIG. 3 and Table 1.

TABLE 1

| | Power Dissipated in a Thermal Print Element | | |
|---|---|---|---|
| n | Rh = 2 | Rh = 0.2 | Rh = 0.02 |
| 100 | 0.191 | 0.218 | 0.222 |
| 1775 | 0.040 | 0.172 | 0.216 |
| 3550 | 0.016 | 0.137 | 0.210 |

With a harness resistance Rh of 2.0 ohms, the power dissipated in each of the thermal print elements when 3550 elements are enabled is approximately 10% of the power dissipated when 100 elements are enabled. By reducing the harness resistance Rh to 0.02 ohms, the power dissipated in each of the thermal print elements when 3550 elements are enabled is approximately 95% of the power dissipated when 100 elements are enabled. A 5% power variation dependent upon scene content is an improved condition; however, a 0% variation is desired. This description has not accounted for the effects of resistance variations between thermal print elements and resistance drops in the power distribution bus inside the thermal head, both of which increase the variation in power dissipation of the thermal print elements.

Numerous attempts have been made to automatically correct for resistance variations between thermal print elements and resistance drops in the power distribution bus inside the thermal head which vary over time. Most thermal printers incorporate driver and other circuitry that control print operations so that it is difficult to obtain access to the contacts of individual print head resistive heating elements. It is relatively easy, however, to determine the voltage at the terminals of the print head connectors. But the voltage across the print head includes parasitic drops across power supply lines, interconnections and other wiring internal to the print head. As described above, these parasitic voltage drops are proportional to the number of heat elements turned on for a print line. As a result, the parasitic voltage drops vary considerably as the number of selected heating elements changes. The varying heat element voltage produces noticeable variations in density of the imprinted picture elements or pixals.

Commonly assigned co-pending U.S. patent application Ser. No. 547,353 filed Jul. 2, 1990, incorporated herein by reference in its entirety, addresses these problems and the prior art and proposes solutions which involve the maintenance of a substantially constant voltage across the selected resistive heat elements, independent of the number of selected heat elements in any given printing line. Several other techniques have been proposed to prevent these variations and the density of their resultant print, including employing separate power sources for each of the heating elements forming a thermal head, providing an individual balancing resistor for each of the heating elements in the head, and adjusting the electrical power applied to each of the resistive elements following production of an unacceptable print. U.S. Pat. No. 4,540,991 briefly identifies these prior art approaches and sets forth a further proposal to employ a resistance value variation detector selectively connected to each of the resistive elements in order to derive compensation data based upon resistance variation in the elements. The resistance compensation data is retained in a memory at addresses corresponding to each of the resistive elements in the printing head and the compensation information is read out from the memory to thereby compensate the printing data for each element before that data is applied to the shift register stages of the thermal printing head. A similar technique is disclosed in U.S. Pat. Nos. 4,887,092 and 4,996,487, where the resistance check values are employed diagnostically or employed to indicate the temperature of the resistive element between each printing line. It remains desirable to provide a print head which overcomes the variations in image density from the desired density due to all of the aforementioned factors.

Normally the voltage amplitude or the pulse width of a constant current pulse provided by a single system power supply is modulated with the binary or programmable digital data corrected for temperature and resistance variations of the entire head or the individual printing head elements as described, for example, in U.S. Pat. No. 4,710,783, incorporated herein by reference in its entirety. The operating system depicted in FIGS. 5 and 6 of the '783 patent provide an environment within which the improvements of the present invention may be practiced.

SUMMARY OF THE INVENTION

This invention provides the individual thermal print elements with individual current sources. In the printing mode, the one or more current sources connected to their respective thermal print elements are enabled allowing selectable currents to pass through each of the selected thermal print elements.

The current sources can be constructed in a binary mode, such that they select one of two currents, one of which results in forming little or no optical density in the viewed image and the second of which results in an optical density being formed.

The current sources can also be constructed in a programmable mode such that the amount of current allowed to flow in each thermal print element is selectable to provide a gradation in optical density. The selection can be made for each thermal head, each image, each pixel or some combination of conditions.

In accordance with the present invention, a thermal printer apparatus of the type comprising a plurality of thermal printing elements coupled between first and second terminals, power supply means coupled to the first and second terminals of the print head for supplying current to said thermal printing elements, and control means coupled to said thermal printing elements for selecting which of said thermal printing elements receives the current supplied by said power supply means is provided with the improvement wherein the said power supply means further comprises individual current sources coupled to a voltage power supply for each of said thermal printing elements, wherein said current sources are coupled to said control means and in circuit with said thermal printing elements to provide a current of selected duration independent of variations in the voltage applied across the plurality of thermal printing elements due to the number of elements enabled.

Preferably the control means of thermal printing apparatus comprises a shift register and gate array having a plurality of stages corresponding in number to the plurality of thermal printing elements for applying control signals having a value for driving each current source associated with the plurality of thermal printing elements.

In another embodiment, a continuous tone thermal printer apparatus is provided comprising: a print head having a plurality of thermal printing elements, one for each image pixel; storage means having an n bit stage shift register associated with each thermal printing element for storing binary encoded words having $2^n$ continuous tone image densities for each image pixel; power supply means coupled in parallel to each of said plurality of thermal printing elements; a switch array and impedance network means coupled to each stage of said n bit stage shift register and to said power supply means for providing one of $2^n$ current values dependent upon the $2^n$ value stored in said register stages; and individual current driver means coupled to said power supply means and said impedance network means for driving current through said thermal printing elements as a function of said $2^n$ value, whereby variations in the voltage applied across said thermal print head due to the number of thermal printing elements enabled has no effect.

BRIEF DESCRIPTION OF THE DRAWINGS

The advantages and features of the present invention will become better understood in reference to the following more detailed description and claims taken in conjunction with the accompanying drawings in which like elements are identified with like symbols and in which:

DETAILED DESCRIPTION OF THE PREFERRED EMBODIMENTS

Figure 1:
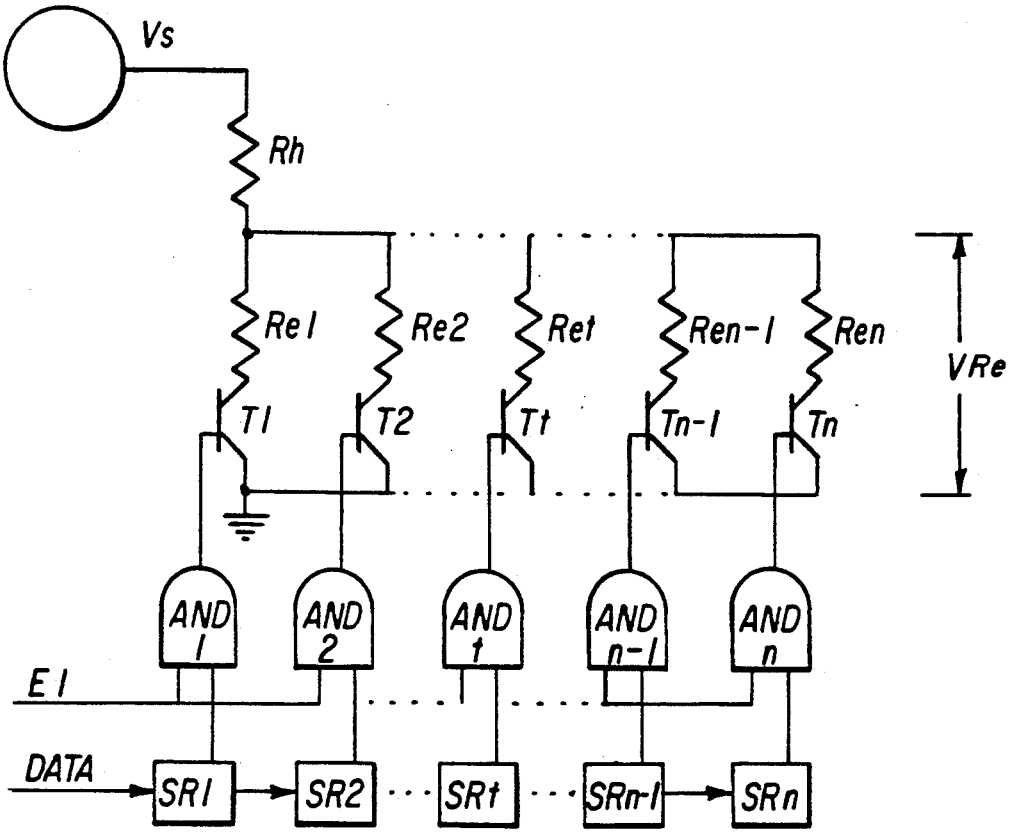
FIG. 1 is a functional schematic of a typical thermal head.
Figure 2:
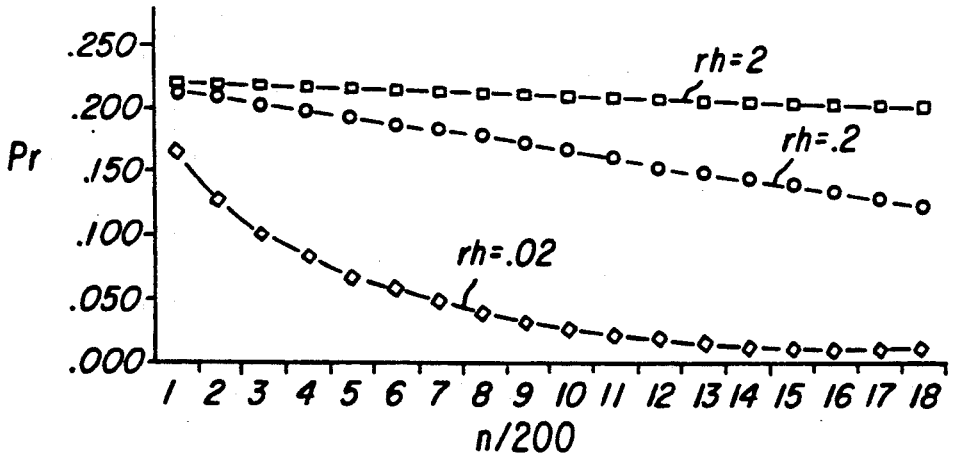
FIG. 2 illustrates in graph form the power dissipated in one element versus the number of elements energized in a thermal print head.
Figure 3:
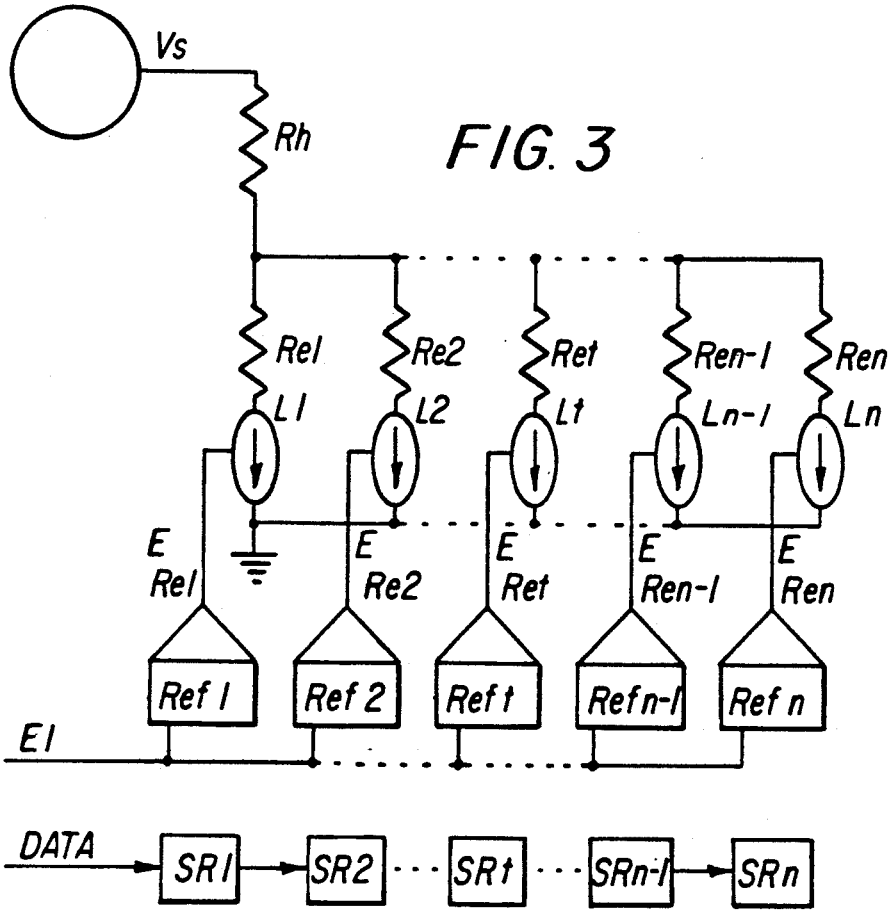
FIG. 3 is a functional schematic diagram of a thermal head employing individual current sources for driving each element.

The power dissipated in a thermal print element, as previously described, is equal to the square of the voltage drop across the thermal print element divided by the resistance of the element. However, the voltage drop across the thermal print elements varies depending upon the image content. A preferred method to deliver power to the thermal print elements is through providing individual current sources for each element. The power dissipated in a thermal print element is then equal to the square of the current flowing through the element times the resistance of the element. The transistors, T1–Tn, described in FIG. 1, are replaced with individual current sources, I1–In, as in FIG. 3. In the printing mode, the shift register, SR1–SRn, is loaded with a logical one at each location corresponding to a pixel where there is a desire to form an optical density. The outputs of the shift register, SR1–SRn, are logically anded with an enable pulse, E1, in the and gates AND-1–ANDn. The enable pulse, E1, is formed to represent the duration that a current is desired to pass through the thermal print elements, Re1–Ren. The output of the gates, AND1–ANDn, enables current sources, I1–In, to allow current to pass through the corresponding thermal print elements, Re1–Ren, to ground.

Figure 4:
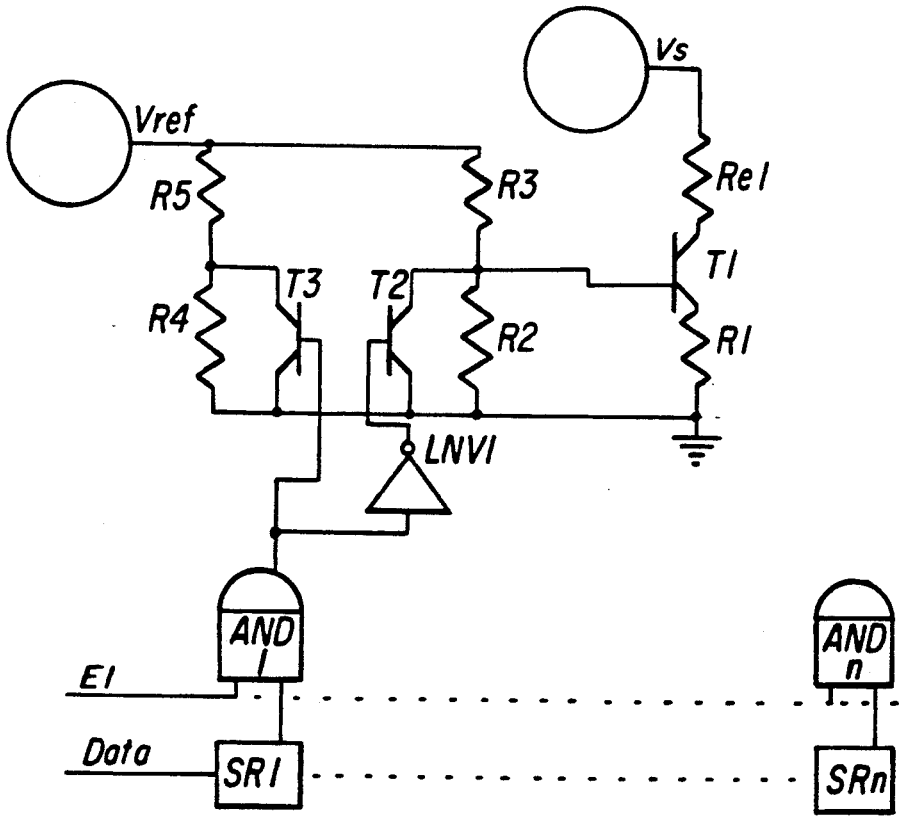
FIG. 4 is a functional schematic diagram of a first embodiment of an individual current source for a thermal print element of a thermal head array.

One possible current source is shown functionally in FIG. 4. The shift register, SR1–SRn, is loaded with a logical "1" at each location corresponding to a pixel where there is a desire to form an optical density. The output of the shift register SR1 is logically "summed" with an enable pulse, ENABLE, in the gate AND1. The inverted output of the gate AND1 is connected to the base of transistor T2. When the output of the gate AND1 is a logical "1", the base of transistor T2 is grounded causing the collector-emitter junction of transistor T2 to go to a high impedance state. The voltage at the base of transistor T1 is then determined by the voltage divider consisting of resistors R2 and R3. The voltage drop across the resistor R1 is equal to the voltage at the base of T1 minus the base to emitter drop (Vbe). The current through resistor R1 (and therefore through the Thermal Print Element Re1) is determined by the value of resistance of R1, the voltage divider formed by resistors R2 and R3 and the voltage Vref. Variations in the voltage applied across the thermal print element due to the number of elements enabled has no effect.

When the output of the and gate AND1 is a logical "0", the base of transistor T2 is held at approximately 3.5 volts causing the collector-emitter junction of transistor T2 to a low impedance state. The current flow through R1 (and therefore the Thermal Print Element Re1) is stopped. This configuration is referred to as a constant current source. The power dissipation can be adjusted by setting the voltage source, Vref, for the desired level.

The output of the and gate AND1 is connected to the base of transistor T3. Resistor R5 is chosen equal to resistor R3. Resistor R4 is chosen equal to resistor R2. The transistors T2 and T3 are enabled and disabled in a complementary manner to maintain the current flow through R2–R5constant without regard to the number of thermal print elements which are energized. Transistors T1–T3 and resistors R2–R5 are replicated for each thermal print element.

Figure 5:
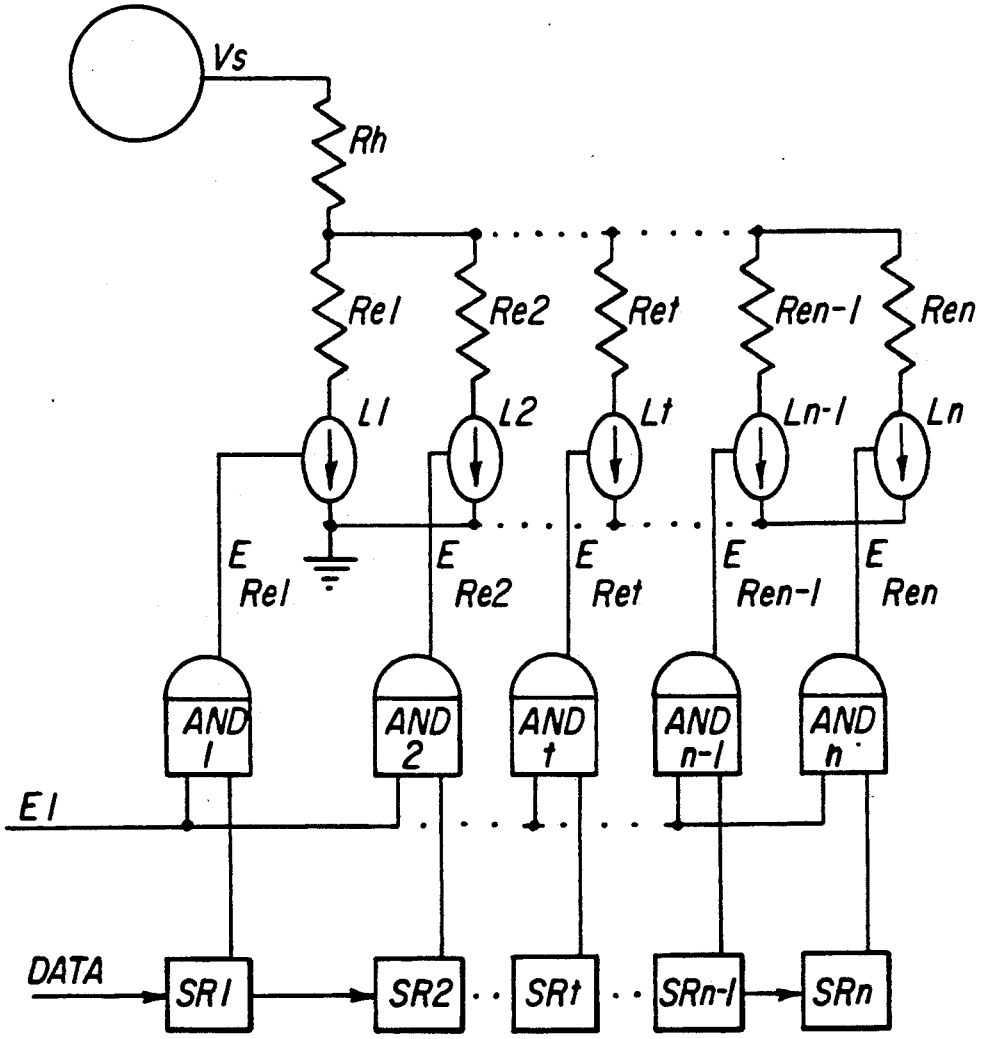
FIG. 5 is a functional schematic diagram of programmable individual current sources for each thermal print element of a thermal head.

An extension of this technique is shown in FIG. 5. The elements of the shift register are expanded to hold one or more bits of data for each thermal print element. The multiple bits select the appropriate analog references in Ref1–Refn for the current sources I1–In for the respective thermal print elements Re1–Ren. The enable pulse, E1, is formed to represent the duration that a current is desired to pass through the thermal print elements, Re1–Ren.

Figure 6:
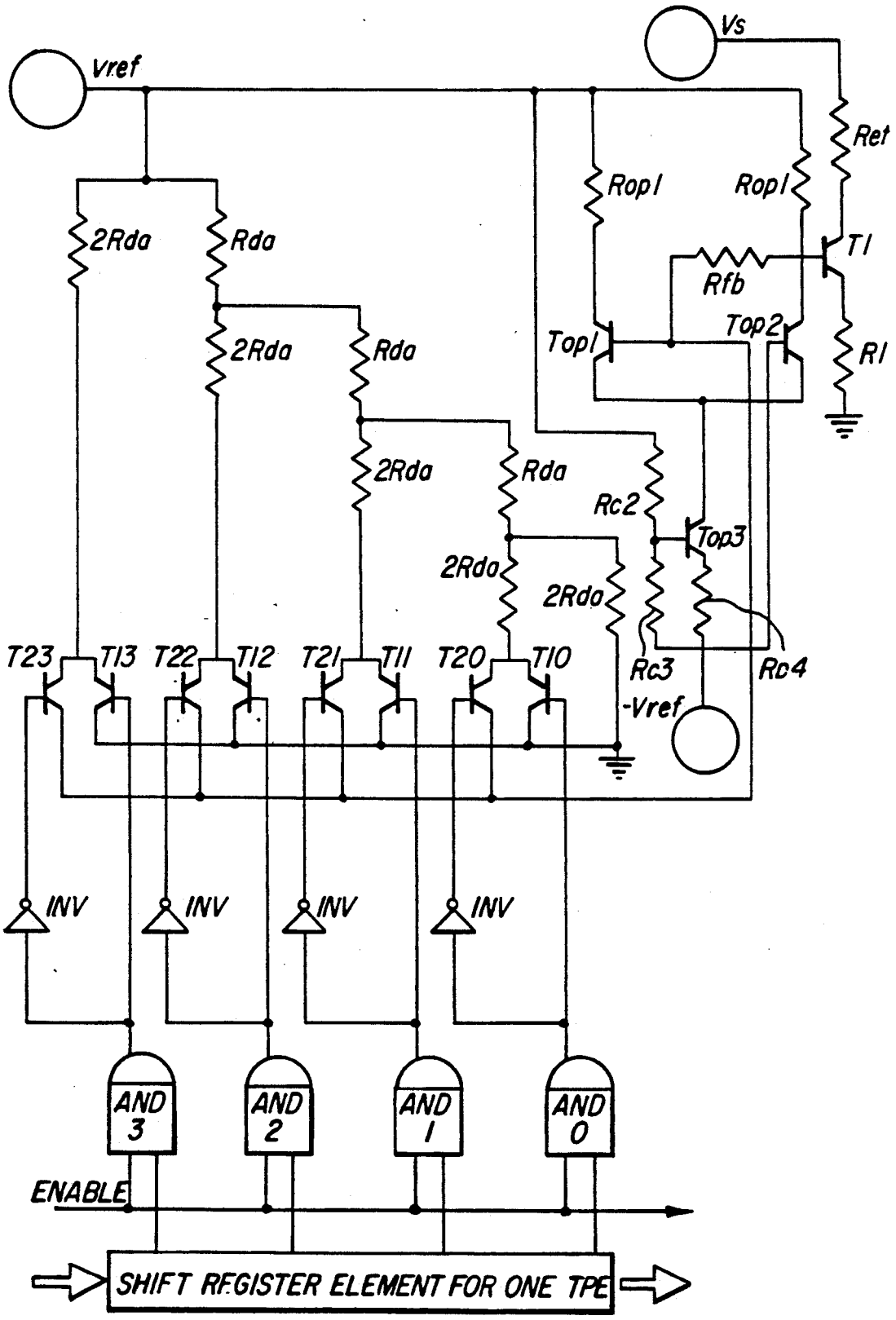
FIG. 6 is a functional schematic diagram of a further embodiment of programmable individual current sources for each thermal print element of a thermal head.

One possible programmable current source, functionally shown in FIG. 6, is an extension of "The Resistive-Ladder D/A Converter" described in the Second Edition of the Electronics Engineer's Handbook by Donald G. Fink (McGraw Hill Book Co., 1982). One or more bits of data are loaded into the shift register elements corresponding to the thermal print elements. Four bits (0–3) are shown in FIG. 6; however, more or fewer bits is a simple extension for anyone trained in the art. The outputs of the shift register are logically "summed" with the Enable input to the gate AND0–AND3. The output of each gate ANDn is inverted in inverter INVn and connected to the base of transistor T2n.

When the output of gate ANDn is a logical "1", current flows through transistor T2n into the inverting input of the operational amplifier constructed with transistors Top1–Top3 and resistors Rop1–Rop4. When the output of gate ANDn is a logical "0", transistor T2n is forced to a high impedance state preventing current flow through transistor T2n into the inverting input of the operational amplifier at transistor Top1. The output of the gate ANDn is connected to the base of transistor T1n. The transistors T1n and T2n are enabled and disabled in a complementary manner to maintain a constant current flow to ground without regard to the individual bits of the 4 bit data stored in the shift register. Transistor T2n provides a path to ground through the virtual ground of the operational amplifier (constructed with transistors Top1–Top3 and resistors Rop-1–Rop4). Transistor T1n provides a path to ground directly.

The resistors in the network connected between the power supply, Vref, and transistors, T1n and T2n, have either value Rda or 2Rda. A resistor of value 2Rda is connected in parallel with a further resistor of value 2Rda and transistor T10. The parallel connection with T10 conducting is equal to a resistance of Rda, assuming that the resistance chip in transistor T10 is negligible when it is conducting, as is well known. If the conducting resistance is not negligible in relation to Rda, the 2Rda can be decreased in the same amount as that resistance.

The parallel combination of the two resistors of value 2Rda (equallying Rda) in series with a further resistance of Rda is equal to the resistance of the resistor 2Rda connected to transistors T21 and T11. Therefore, the current available to transistor T21 is twice that available to transistor T20. This analysis can be extended up the ladder for all four bits in the shift register stage coupled to the eight gates AND0–AND3. Thus, the combined current flow through the conducting most significant bit transistors (T23 or T13) will be $2^4$ greater than the current flow through the least significant bit transistors (T20 or T10), since the total resistance decreases by the parallel effective resistance combinations.

The voltage at the base of transistor T1 is therefore determined by the value chosen for the feedback resistor of the operational amplifier (constructed with transistors Top1–Top3 and resistors Rop1–Rop4) and the sum of the currents from the ladder network at base of transistor Top1. As previously described for FIG. 4, the voltage drop across the resistor R1 is equal to the voltage at the base of T1 minus the base to emitter drop (Vbe). The current through resistor R1 (and therefore through the Thermal Print Element Ret) is determined by the value of resistance of R1, the voltage out of the operational amplifier and the voltage Vref. Variations in the voltage applied across each thermal print element due to the number of elements enabled therefore has no effect. As a result, the power supply may be easily adjusted to provide appropriate operating current to all the print elements by adjusting Vref and -Vref to achieve optimum print quality in calibration runs.

Although preferred embodiments of the invention have been described in conjunction with driving thermal printing elements, it will be understood that the principles of the invention may be extended to driving other print elements, e.g., thermal ink jet print elements or other resistive load print elements.

While the invention has been described with reference to the disclosed embodiments, it is not confined to the details thereof, but is intended to encompass such modifications and changes as may be suggested to those skilled in the art as the technology develops equivalent to the same.

What is claimed is:

1. In a thermal printer apparatus of the type comprising:

a plurality of thermal printing elements coupled between first and second terminals;

power supply means coupled to the first and second terminals of the print head for supplying current to said printing elements; and control means coupled to said printing elements for providing a first binary data signal for selecting which of said printing elements receives the current supplied by said power supply means;

the improvement wherein said power supply means further comprises individual current sources coupled to a reference voltage source for each of said printing elements, wherein said current sources each include first and second paths and first and second switch means responsive to first and second binary data signals provided by said control means for connecting either the first or the second current path to said reference voltage source, said first current path being in each case coupled in circuit with said power supply means and a corresponding printing element to provide a current of selected duration thereto in response to first binary signal data independent of variations in the voltage applied across the plurality of printing elements due to the number of elements enabled.

2. The printing apparatus of claim 1 wherein said control means comprises a shift register having a plurality of stages corresponding in number to the plurality of printing elements for providing said binary data signals having a first or second binary value and a gate array coupled to said first and second switches for driving each current source associated with the plurality of printing elements into conduction through said first or said second current path.

3. A continuous tone printer apparatus comprising:

a print head having a plurality of printing elements, one for each image pixel;

means having an n-bit shift register associated with each printing element for storing binary encoded words having one of a possible $2^n$ image densities for each image pixel;

primary power supply means coupled in parallel to each of said plurality of printing elements;

reference power supply means for providing a driving and dissipating current;

decoding means coupled to each of said n-bit shift registers for decoding each stored n-bit binary encoded word and providing one of $2^n$ possible driving current magnitudes dependent upon the n-bit binary word stored in said register stages and for providing a complementary dissipating current magnitude which when added to the driving current magnitude equals a constant magnitude;

individual current driver means coupled to said reference power supply means and said decoding means for driving the decoded driving current magnitudes through each of said printing elements independent of the number of elements enabled; and individual current dissipating current means coupled to said reference power supply means and to said decoding means for dissipating the complementary dissipating current magnitude through impedance network means, whereby a constant load is presented to the reference power supply means.

* * * * *